US008240936B2

(12) United States Patent
Vazquez et al.

(10) Patent No.: US 8,240,936 B2
(45) Date of Patent: Aug. 14, 2012

(54) TOOTHBRUSH HAVING SOFT TISSUE CLEANING ELEMENTS

(75) Inventors: Joe Vazquez, Hamilton, NJ (US); Douglas J. Hohlbein, Pennington, NJ (US); Thomas J. Boyd, Metuchen, NJ (US); Rensl Dillon, Ewing, NJ (US); Gary Gerard Bredael, Langhorne, PA (US); Craig Anthony Hidalgo, Langhorne, PA (US); Alexander James Sinton, Doylestown, PA (US); Thomas John Powers, Titusville, NJ (US)

(73) Assignee: Colgate-Palmolive Company, New York, NY (US)

( * ) Notice: Subject to any disclaimer, the term of this patent is extended or adjusted under 35 U.S.C. 154(b) by 1094 days.

(21) Appl. No.: 11/677,622

(22) Filed: Feb. 22, 2007

(65) Prior Publication Data

US 2008/0201884 A1 Aug. 28, 2008

(51) Int. Cl.
*A46B 11/04* (2006.01)
*A47L 13/26* (2006.01)

(52) U.S. Cl. ..... 401/282; 401/37; 401/39; 401/184; 401/270

(58) Field of Classification Search ..... 401/188 R, 401/132–134, 282, 284, 286, 287, 288, 270, 401/184, 16, 37–39, 183; 15/110, 111
See application file for complete search history.

(56) References Cited

U.S. PATENT DOCUMENTS

| | | | | |
|---|---|---|---|---|
| 5,865,195 | A | 2/1999 | Carter | |
| 5,915,868 | A * | 6/1999 | Frazell | 401/132 |
| 6,119,296 | A | 9/2000 | Noe et al. | |
| 6,276,021 | B1 | 8/2001 | Hohlbein | |
| 7,641,410 | B2 * | 1/2010 | Frazell | 401/184 |
| 2003/0077107 | A1 | 4/2003 | Kuo | |
| 2004/0060135 | A1 | 4/2004 | Gatzemeyer | |
| 2004/0237226 | A1 | 12/2004 | Hohllbein | |
| 2006/0026784 | A1 | 2/2006 | Moskovich et al. | |
| 2008/0014010 | A1 | 1/2008 | Bartschi et al. | |

FOREIGN PATENT DOCUMENTS

| | | | |
|---|---|---|---|
| CA | 2653927 | | 12/2007 |
| CN | 1718134 | A | 1/2006 |
| DE | 202005009026 | U1 | 10/2005 |
| EP | 0872195 | A2 | 10/1998 |
| EP | 1190643 | A1 | 3/2002 |
| GB | 2040161 | A | 8/1980 |
| GB | 2263863 | A | 8/1993 |
| TW | 200513210 | A | 4/2005 |
| TW | 200630074 | | 9/2006 |

(Continued)

OTHER PUBLICATIONS

International Search Report Dated Jun. 27, 2008.
Office Action dated Nov. 25, 2010 from the State Intellectual Property Office, P.R. China relating to corresponding Chinese Patent Application No. 200880013116.1 (PCT/US2008/054038).

(Continued)

*Primary Examiner* — David Walczak
(74) *Attorney, Agent, or Firm* — Amy M. Fernandez

(57) ABSTRACT

An oral care implement includes a head and a plurality of cleaning elements for enhanced cleaning of the teeth and soft tissue of the oral cavity. One tooth cleaning element has a plurality of bristles adapted to clean teeth. Another cleaning element is connected to the head and has structure defining a channel. The channel is configured to direct fluid in contact with the head toward an edge of the head when the implement is moved. The head also defines a reservoir that is configured to receive a dentifrice therein.

29 Claims, 18 Drawing Sheets

FOREIGN PATENT DOCUMENTS

| | | | |
|---|---|---|---|
| WO | 0053053 | A1 | 9/2000 |
| WO | 0121036 | A1 | 3/2001 |
| WO | WO 2004/028235 | | 4/2004 |
| WO | WO 2004/112538 | | 12/2004 |
| WO | 2006055369 | A1 | 5/2006 |

OTHER PUBLICATIONS

Office Action dated Jan. 12, 2011 from the Taiwan Intellectual Property Office relating to corresponding Taiwan Patent Application No. 097105990.

* cited by examiner

TOOTHBRUSH HAVING SOFT TISSUE CLEANING ELEMENTS

FIELD OF THE INVENTION

The present invention pertains to a toothbrush with an enhanced cleaning head.

BACKGROUND OF THE INVENTION

A toothbrush is used to clean teeth by removing plaque and debris from surfaces of the teeth. Conventional toothbrushes typically have a head having tufts of bristles and may also have other types of cleaning structures such as for cleaning soft tissue surfaces. Some toothbrushes are equipped with structures designed to clean soft tissue, such as gum tissue. Such toothbrushes have a limited ability to retain actives such as dentifrice on the cleaning elements for application onto the teeth and soft tissue. During the brushing process, the dentifrice typically slips through the elements and away from the contact between the elements and the teeth. In addition, the elements do not sufficiently direct dentifrice and associated fluids more towards the mouth surfaces to be cleaned. As a result, the dentifrice often is spread around the mouth, rather than being delivered in a controlled manner to the contact of the elements with the gum tissue and the teeth. Therefore, the efficiency of the cleaning process is reduced. Hence, there is an unmet need to overcome these limitations and other drawbacks of conventional toothbrushes, and to provide new features not heretofore available to enhance oral hygiene.

BRIEF SUMMARY OF THE INVENTION

The invention pertains to a toothbrush with a configuration of cleaning elements to provide superior cleaning of soft oral tissue and teeth.

The present disclosure provides an oral care implement that includes a head and a plurality of cleaning elements for enhanced cleaning of the teeth and soft tissue. One tooth cleaning element has a plurality of bristles adapted to clean teeth. Another cleaning element is connected to the head and has structure defining one or more channels. The channels are configured to direct fluid in contact with the head toward an edge of the head when the implement is moved.

According to one aspect, the structure defining the channels includes a plurality of members spaced from one another to define the channels within gaps between the members.

According to another aspect, the members defining the channels can include a plurality of protrusions forming a plurality of elongated ridges. These structures define the plurality of channels therebetween such that the channels are recessed relative to the protrusions.

According to another aspect, the ridges and channels can have a variety of shapes, including serpentine shapes, arched shapes, and curved, elongated shapes.

The present disclosure also provides an oral care implement that includes a head and a plurality of cleaning elements for enhanced cleaning of the teeth and soft tissue. One tooth cleaning element has a plurality of bristles adapted to clean teeth. Another cleaning element includes a base connected to the head, and a reservoir defined and configured to receive a dentifrice therein.

According to one aspect, the reservoir is a recess defined on an outer surface of the base.

According to another aspect, the reservoir is a cavity defined between the base and the head.

According to another aspect, the base has an aperture extending therethrough connecting the cavity to an exterior of the base.

According to another aspect, the base of the cleaning element has a plurality of protrusions thereon, and the protrusions define a plurality of elongated channels therebetween. The channels are recessed relative to the protrusions, and the channels are configured to direct the dentifrice toward an edge of the head when the implement is moved.

Other features and advantages of the invention will become apparent from the following description taken in conjunction with the following drawings.

DETAILED DESCRIPTION OF THE INVENTION

In the following description, the invention is discussed in terms of a toothbrush, but could be in the form of other oral care implements including simply a tissue cleansing implement. Further, it is understood that other embodiments may be utilized and structural and functional modifications may be made without departing from the scope of the present invention.

Figure 1:
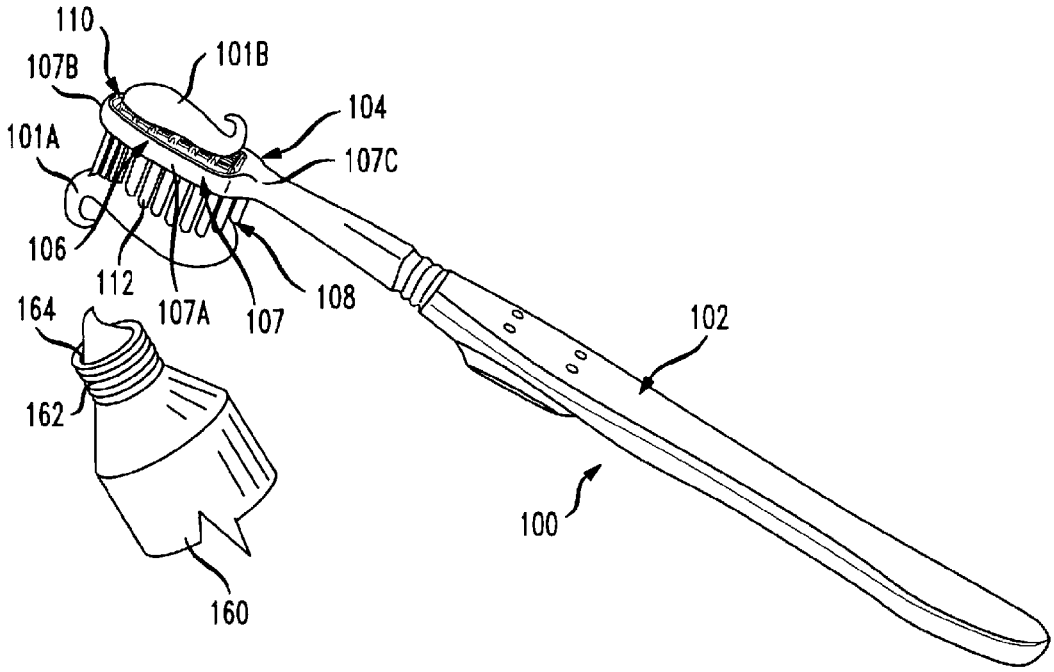
FIG. 1 is a perspective view of a toothbrush according to one or more aspects of an illustrative embodiment, the toothbrush having active substances applied thereto.

FIG. 1 illustrates an oral care implement, or toothbrush, generally referred to with the reference numeral 100. The toothbrush 100 generally including a handle 102 and a head 104 connected to the handle 102. The toothbrush 100 may be used for cleaning the teeth and soft tissue in the mouth, such as the tongue or interior surfaces of the cheeks, lips, or gums. The toothbrush 100 generally has a longitudinal axis.

The handle 102 is generally an elongated member that is dimensioned for the user to readily grip and manipulate the toothbrush 100. The handle 102 may be formed of many different shapes and with a variety of constructions. The handle 102 may have a neck portion directly adjacent to the head 104, which may be narrowed relative to the head 104 and/or other portions of the handle 102. In one embodiment, the handle 102 is integrally formed with the head 104 although other constructions are possible. While in the embodiments illustrated herein the head 104 is widened relative to the neck of the handle 102, it could in some constructions simply be a continuous extension or narrowing of the handle 102.

Figure 2:
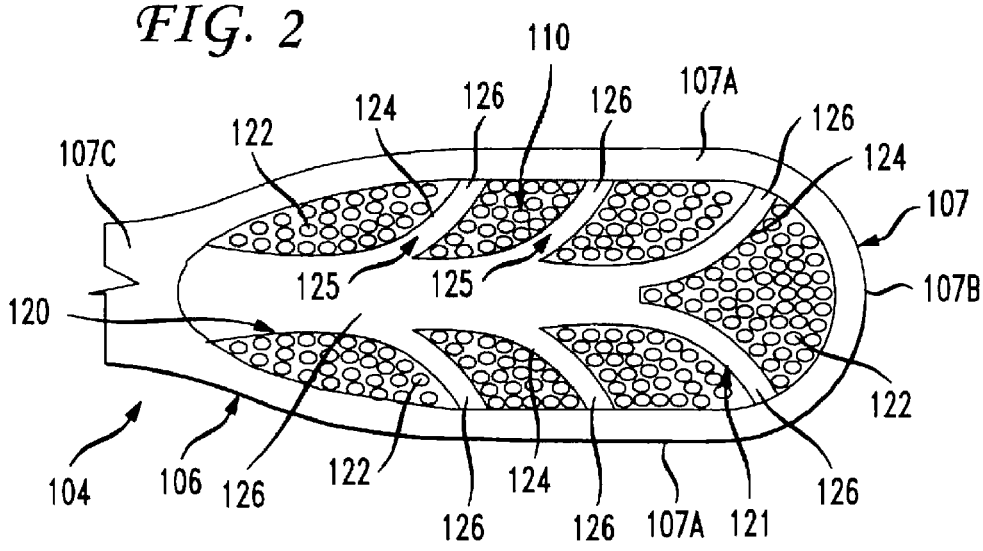
FIG. 2 is a plan view of one embodiment of a head of a toothbrush.
Figure 3:
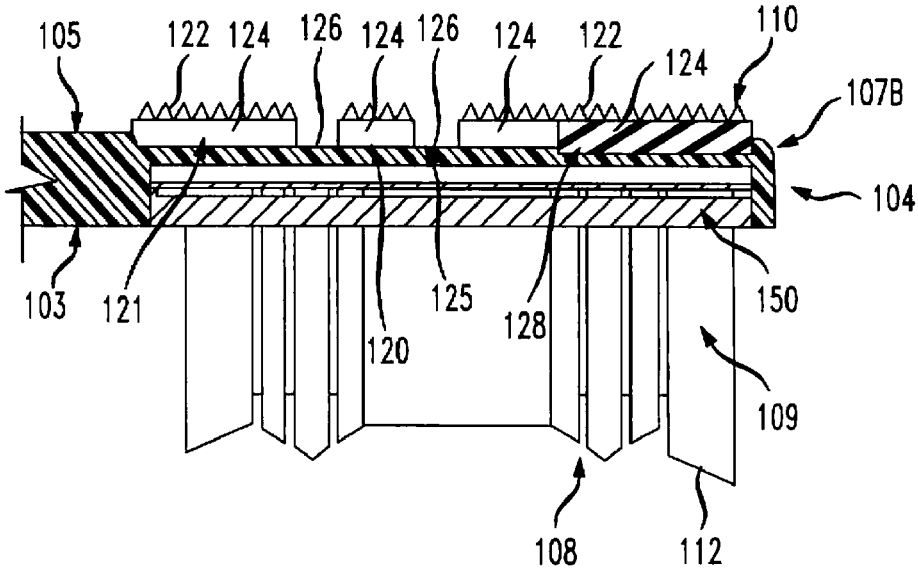
FIG. 3 is a cross-sectional view of the toothbrush head of FIG. 2.

As generally shown in FIGS. 1-3, the head 104 typically has a first face 103 and second face 105 that support cleaning elements, as described below. The head 104 also has peripheral edges or ends 107, including lateral edges or ends 107A, a distal edge or end 107B farthest from the point where the handle 102 connects to the head 104, and a proximal edge or end 107C nearest the point where the handle 102 connects to the head 104. In the constructions illustrated herein, the first face 103 and second face 105 are on opposed sides of the head 104. However, in other constructions, the cleaning elements are mounted elsewhere on the head 104. Additionally, as described below, the one or more of the cleaning elements may extend from the face 103,105 to which it is connected to other parts of the brush 100, such as the peripheral edges 107 of the head 104 or the neck portion of the handle 102.

Dentrifice

The brush or other oral care implement 100 is adapted to be used with one or more actives 101, as shown in FIG. 1. Actives 101 are known in the art, and are generally substances designed to cause one or more beneficial effects when distributed in the oral cavity. Actives can provide therapeutic benefits that, for example, alleviate dry mouth conditions, decrease putative bacteria, reduce formation of volatile sulfur compounds, inhibit biofilm formation on soft tissues, reduce dental plaque and/or gingivitis, improve mouth odor, clean interior surfaces of the oral cavity, and whiten and/or deliver fluoride to teeth. Accordingly, a non-exhaustive list of actives for which the disclosed implement is suitable includes: bacteriostat or antibacterial agents such as chlorhexidine, cetyl pyridinium chloride, ethyl lauroyl argening HCl, triclosan, zinc salts, or magnolia extract; oxidative or whitening agents, such as hydrogen peroxide, urea peroxide, sodium percarbonate, or PVP-$H_2O_2$; supercharged fluoride delivery ingredients; tooth sensitivity ingredients, such as $KNO_3$; gum health actives, including those that reduce inflammation pathways, and/or interfere in bacterial processes which result in inflammatory stimuli, such as Univestin® from Unigen Pharma, bachalin, polyphenols, triclosan, ethyl pyruvate, magnolia extract, and guanidinoethyl disulfide; "nutritional" type ingredients such as vitamins, minerals, amino acids, Vitamin E, folic acid, etc.; tartar control or anti-stain ingredients, including phosphate salts, polyvinylphosphoric acid, or PVM/MA copolymer; enzymes, such as those used for plaque disruption; sensate ingredients, such as those providing cooling, tingling, or heat; flavors and flavor ingredients; a cleaning agent or one that aids in exfoliation; dissolving agent, such as a film; and indicator dye, which changes color during brushing to indicate when enough brushing has occurred; or combinations thereof.

One typical form of the active 101 is a dentifrice, which is a shear-sensitive visco-elastic material which is easily dispensed from a tube (having advantageous yield stress and shear thinning properties) and breaks cleanly after application to a toothbrush (known as stringiness), yet recovers its structure on the brush, i.e. "stand up" (known as thixotropy). Commonly-known toothpastes are examples of dentifrices. A dentifrice preferably has a rheological profile that facilitates dissolution and dispersion, such has being very sensitive to brushing shear rate in the oral cavity, breaking down quickly and mixing with saliva. Some common dentifrice products have viscosities between 100-1000 Pa·s at low shear rates, but when mixed with saliva in ratios of 1:1 to 1:4 (dentifrice: saliva), these viscosities fall to 0.01-1.0 Pa·s. Improving dispersion and dissolution of the dentifrice or other active 101 in the oral cavity allows these viscosity rates to be reached more quickly and consistently during oral care.

Cleaning Elements

In the construction shown in FIG. 1, the head 104 has support member 106 with a first cleaning element 108 and a second cleaning element 110 connected thereto, thereby supporting the cleaning elements 108,110. The cleaning elements 108, 110 are generally configured for cleaning one or more portions of the mouth, including teeth and soft tissues. Actives 101 may be applied to either or both of the cleaning elements 108, 110, as illustrated in FIG. 1. The actives 101A, 101B shown in FIG. 1 may both be the same active 101, or may be different actives 101, and more than one active 101 may be applied to each cleaning element 108, 110. It is understood that in some constructions, one or both of the first and second cleaning elements 108, 110 can be considered part of the head 104.

Generally, the first cleaning element 108 is a tooth cleaning element configured to clean the teeth of a user (not shown) by moving the brush 100 with the cleaning element 108 in contact with the teeth. The first tooth cleaning element 108 is commonly formed from a plurality of bristles 112 extending from the first face 103 of the head 104, as in FIG. 1. The bristles may be in the form of tufts of bristles 112 or other configurations, as are known. Other configurations for the first cleaning element 108 are possible, such as a combination of bristles 112 and other cleaning structures. The first cleaning element 108 can be attached to the support member 106 by known methods. It is understood that the bristles 112 are preferably made from nylon, although other materials could be used. The bristles 112 also preferably have a generally circular cross-sectional shape, but could have other cross-sectional shapes as well. The diameter of the bristles 112 can also vary depending on the desired cleaning action of the bristles 112. In the constructions shown in FIGS. 2-32, the first cleaning element 108 comprises a plurality of bristles 112 attached to a brush insert 109. The brush insert 109 is then mounted within a recess 150 on the first face 103 of the head 104.

FIGS. 2-32 show different constructions of the second cleaning element 110. Generally, the second cleaning element 110 is adapted to improve the dissolution and dispersion of the actives 101 in the oral cavity, in combination with the first cleaning element 108 and the other components of the head 104. Additionally, the second cleaning element 110 is adapted to clean portions of the oral cavity. For example, in some constructions, the second cleaning element 110 is adapted to clean soft tissues in the mouth, such as the tongue or interior surfaces of the cheeks, lips, or gums. In some exemplary constructions, the second cleaning element 110 improves dissolution and dispersion of the actives 101 through channels configured to direct a fluid in contact with the head 104 toward an edge 107 of the head 104 when the brush 100 is moved in the oral cavity. In some other exemplary constructions, the second cleaning element 110 improves dissolution and dispersion of the actives 101 through a reservoir adapted to receive a dentifrice therein. In addition, the second cleaning element 110 may have a profile or structure to mate with a cap 162 or opening 164 of a dispenser 160 for the active 101, for example, as illustrated in FIG. 12. Exemplary constructions of oral care implements 100 utilizing one or both of these features are described below. In the constructions described herein, the second cleaning element 110 is generally attached to the support member 106 of the head 104 by inserting the base 120 of the cleaning element 110 into a recess 128 in the support member 106.

In some toothbrush constructions, such as the exemplary constructions illustrated in FIGS. 2-11, the toothbrush 100 has a second cleaning element 110 that includes a base 120 attached to the second face 105 of the head 104, the base 120 having structure defining at least one channel 126 on the head 104. The channel 126 is configured to direct fluid in contact with the head 104 toward an edge 107 of the head 104 and to disperse the fluid around the second cleaning element 110 when the implement 100 is moved in the oral cavity. Such a fluid may consist of an active/dentifrice 101, water, saliva, or other fluid substance, or a mixture of such substances. In some constructions, protrusions 122 associated with the second cleaning element 110 are made of a polymeric material, such as linear low-density polyethylene (LLDPE), a thermoplastic elastomer (TPE), or other flexible material.

Previous nubs and other protrusions have been made from TPE materials, which are rubbery and soft. However, TPE materials are not well suited to flowing into thin, tight spaces because of their inherent rheology, and also often create waxy deposits in molds, making them difficult to manufacture. LLDPE materials are still soft, but have superior flow characteristics that are well suited to filling very thin sections, and thus, can be more easily manufactured and can be manufactured to have thinner profiles. Accordingly, in some constructions, at least a portion of the second cleaning element 110, including the protrusions 122, is manufactured from LLDPE or a similar material. In general, LLDPE has a higher flexural modulus than TPE, and thus, in some constructions, the LLDPE protrusions are formed as long, thin bristle-like protrusions to provide increased softness.

In some constructions, the structure defining the channel(s) 126 is a plurality of members 121 spaced from one another to define each channel 126 within a gap 125 between the members 121. In the constructions illustrated in FIGS. 2-11, these members 121 include a plurality of protrusions 122 extending outwardly and/or a plurality of elongated ridges 124, which are located on the base 120 or other portion of the head 104. In some constructions, the protrusions 122 form the plurality of elongated ridges 124 on the base 120, and these ridges 124 define a plurality of channels 126 therebetween, such that the channels 126 are recessed relative to the ridges 124 and the protrusions 122. In some constructions, the protrusions are formed into specialized shapes, such as bristle-like structures (See, e.g., FIG. 11), nubs (See, e.g., FIG. 9) or ribs (See, e.g., FIG. 5), for obtaining desired cleaning action. In other constructions, the protrusions 122 may be grouped into specialized shapes, or the protrusions 122 may have smaller protrusions 122 thereon (See, e.g., FIG. 9).

FIGS. 2-3 illustrate a toothbrush 100 having a second cleaning element 110 that includes a base 120 attached to the second face 105 of the head 104, the base 120 having a plurality of protrusions 122 thereon. The protrusions 122 form a plurality of elongated ridges 124 on the base 120, and each ridge 124 has a series of smaller nub protrusions 122 thereon. These ridges 124 define a plurality of channels 126 therebetween. Both the ridges 124 and the channels 126 are elongated and extend outwardly from a point proximate a center portion of the base 120 to the lateral edges 107A of the head 104. The channels 126 are configured to direct a fluid in contact with the head 104 toward the lateral edges 107A of the head 104 and to disperse the fluid around the second cleaning element 110 when the implement 100 is moved in the oral cavity. Additionally, the channels 126 proximate the distal edge 107B of the head 104 also direct the fluid toward the distal edge 107B. In one exemplary construction, the channels 126 are open at the edges 107 of the head 104. In the construction shown, the channels 126 and ridges 124 are symmetrical on each side of the head 104 and extend from a central pathway at the center portion of the head 104.

Figure 4:
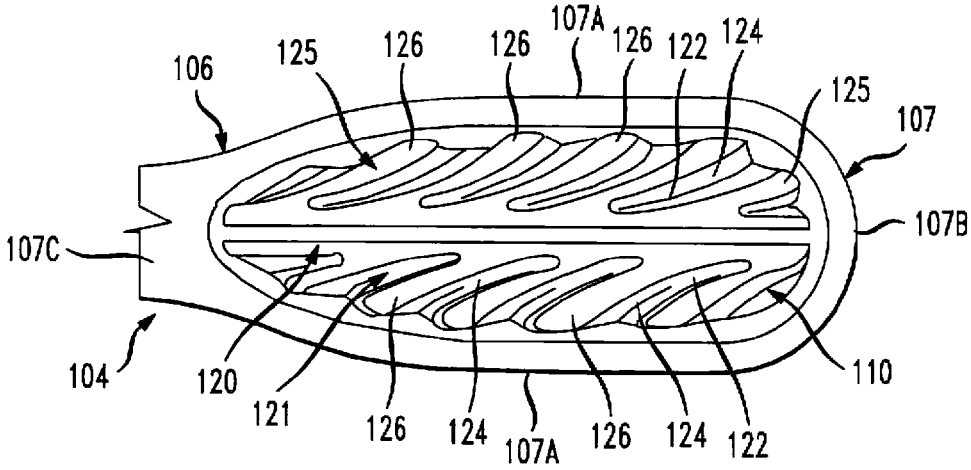
FIG. 4 is a plan view of another embodiment of a head of a toothbrush.
Figure 5:
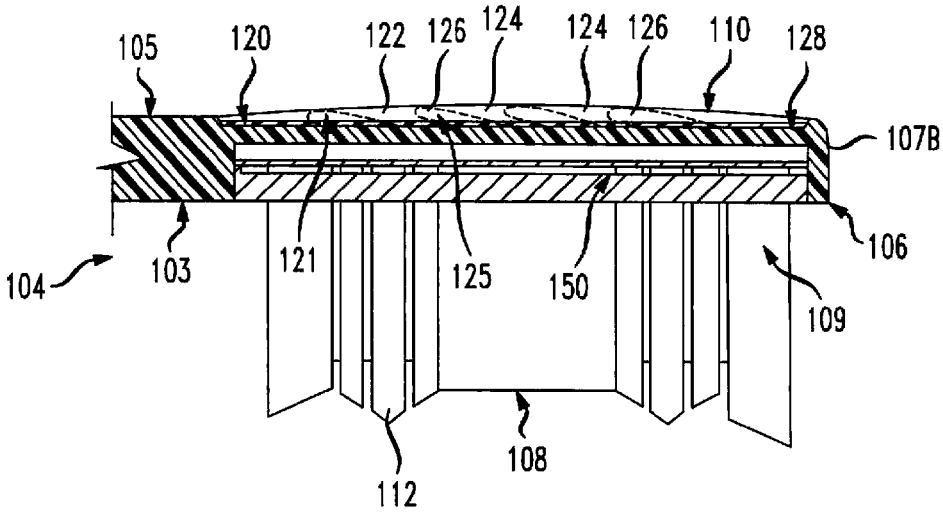
FIG. 5 is a cross-sectional view of the toothbrush head of FIG. 4.

FIGS. 4-5 illustrate a toothbrush 100 having a second cleaning element 110 that includes a base 120 attached to the second face 105 of the head 104, the base 120 having a plurality of protrusions 122 thereon. Each of the rib-like protrusions 122 itself forms a ridge 124, and the ridges 124 define a plurality of channels 126 therebetween. Both the ridges 124 and the channels 126 extend in an elongated, curvilinear manner from a point proximate a centerline or center portion of the base 120 to the lateral edges 107A of the head 104. The channels 126 are configured to direct a fluid in contact with the head 104 toward the lateral edges 107A of the head 104 and to disperse the fluid around the second cleaning element 110 when the implement 100 is moved in the oral cavity. Additionally, some of the channels 126 proximate the distal edge 107B and the proximal edge 107C of the head 104 also direct the fluid toward the distal edge 107B and the proximal edge 107C. Accordingly, the channels 126 direct fluid generally about the periphery of the head 104.

Figure 6:
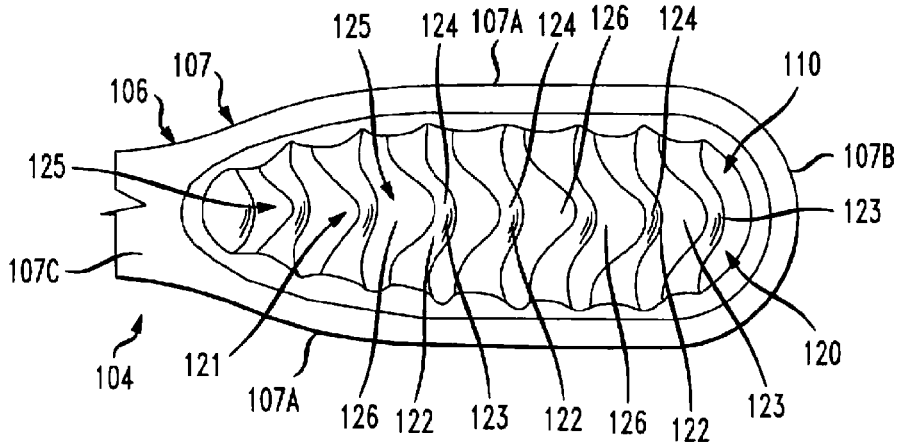
FIG. 6 is a plan view of another embodiment of a head of a toothbrush.
Figure 7:
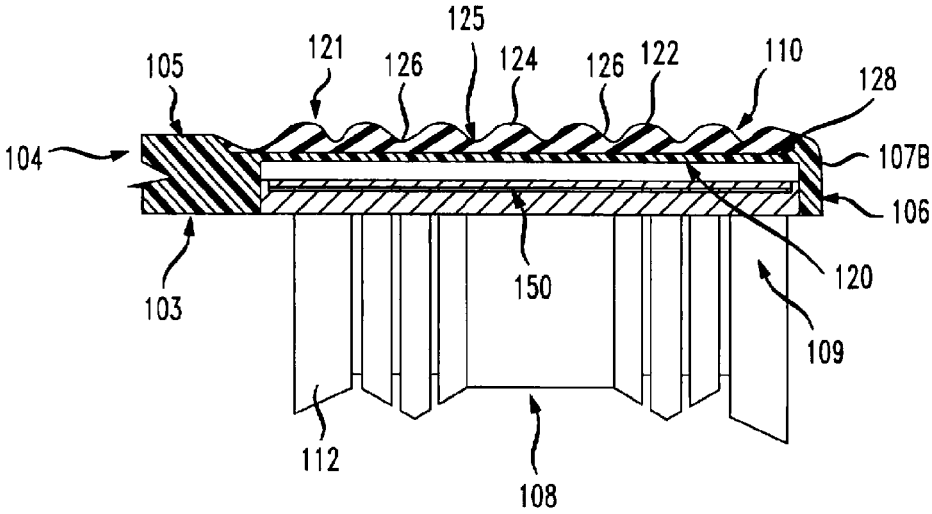
FIG. 7 is a cross-sectional view of the toothbrush head of FIG. 6.

FIGS. 6-7 illustrate a toothbrush 100 having a second cleaning element 110 that includes a base 120 attached to the second face 105 of the head 104, the base 120 having a plurality of protrusions 122 thereon. Each of the protrusions 122 itself forms a ridge 124, and the ridges 124 define a plurality of channels 126 therebetween. Both the ridges 124 and the channels 126 extend in an elongated, curvilinear manner from one lateral edge 107A of the head 104 to the other lateral edge 107A of the head 104, and both the ridges 124 and the channels 126 have an arch 123 proximate the center of the head 104. The channels 126 are configured to direct a fluid in contact with the head 104 toward the lateral edges 107A of the head 104 and to disperse the fluid around the second cleaning element 110 when the implement 100 is moved in the oral cavity. Additionally, some of the channels 126 proximate the distal edge 107B and the proximal edge 107C of the head 104 also direct the fluid toward the distal edge 107B and the proximal edge 107C, respectively. In the construction shown, the channels 126 and ridges 124 are symmetrical on each side of the head 104.

Figure 8:
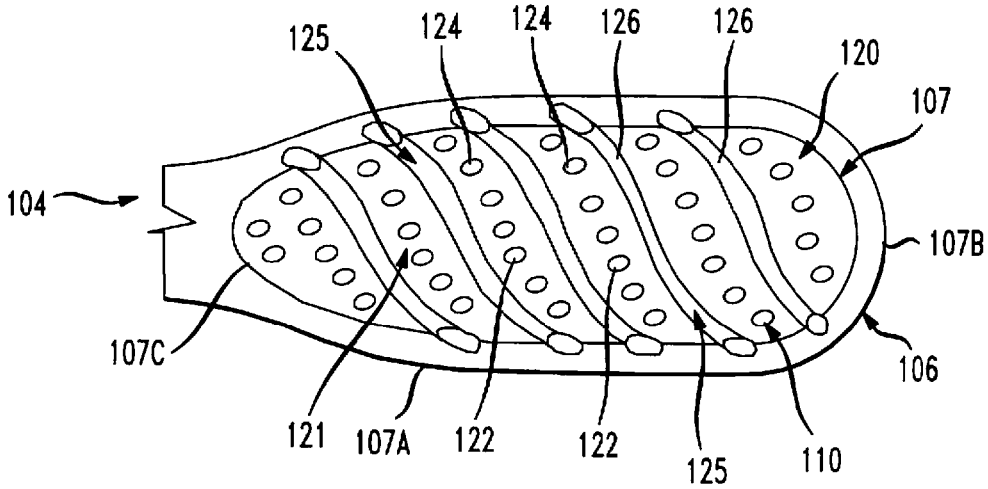
FIG. 8 is a plan view of another embodiment of a head of a toothbrush.
Figure 9:
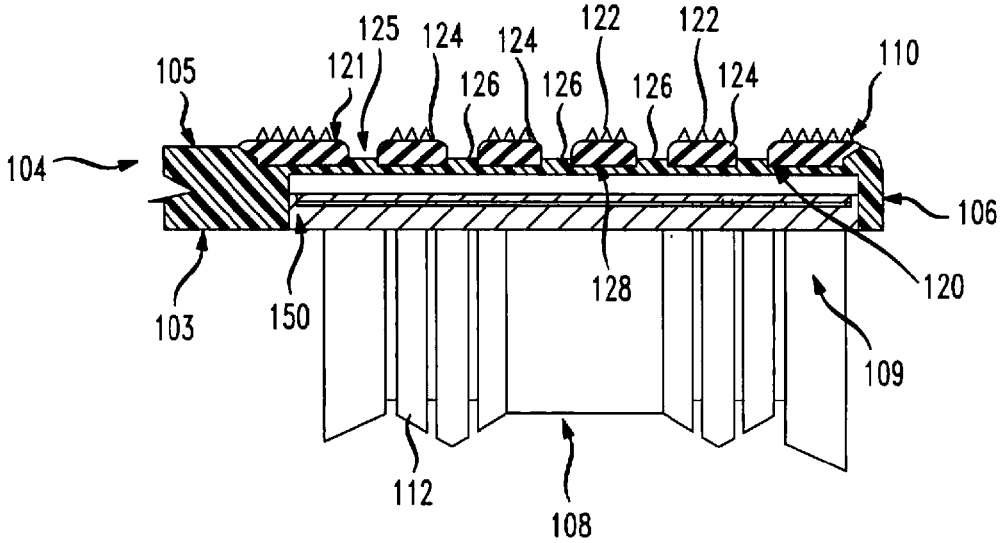
FIG. 9 is a cross-sectional view of the toothbrush head of FIG. 8.

FIGS. 8-9 illustrate a toothbrush 100 having a second cleaning element 110 that includes a base 120 attached to the second face 105 of the head 104, the base 120 having a plurality of protrusions 122 thereon. Each of the protrusions 122 itself forms a ridge 124, and the ridges 124 define a plurality of channels 126 therebetween. Both the ridges 124 and the channels 126 extend in an elongated, curvilinear manner from one lateral edge 107A of the head 104 to the other lateral edge 107A of the head 104, and both the ridges 124 and the channels 126 are serpentine in shape. In other modifications, the serpentine shape of the channels 126 may be more pronounced or substantially serpentine in shape. The channels 126 are configured to direct a fluid in contact with the head 104 toward the lateral edges 107A of the head 104 and to disperse the fluid around the second cleaning element 110 when the implement 100 is moved in the oral cavity. Additionally, some of the channels 126 proximate the distal edge 107B and the proximal edge 107C of the head 104 also direct the fluid toward the distal edge 107B and the proximal edge 107C, respectively. Further, the protrusions 122 also have smaller nub protrusions 122 thereon to enhance cleaning of soft tissues in the oral cavity.

Figure 10:
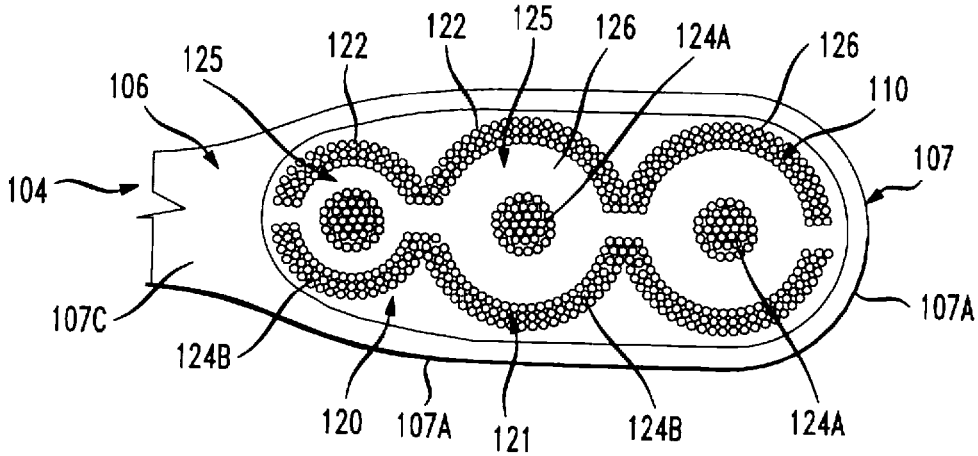
FIG. 10 is a plan view of another embodiment of a head of a toothbrush.
Figure 11:
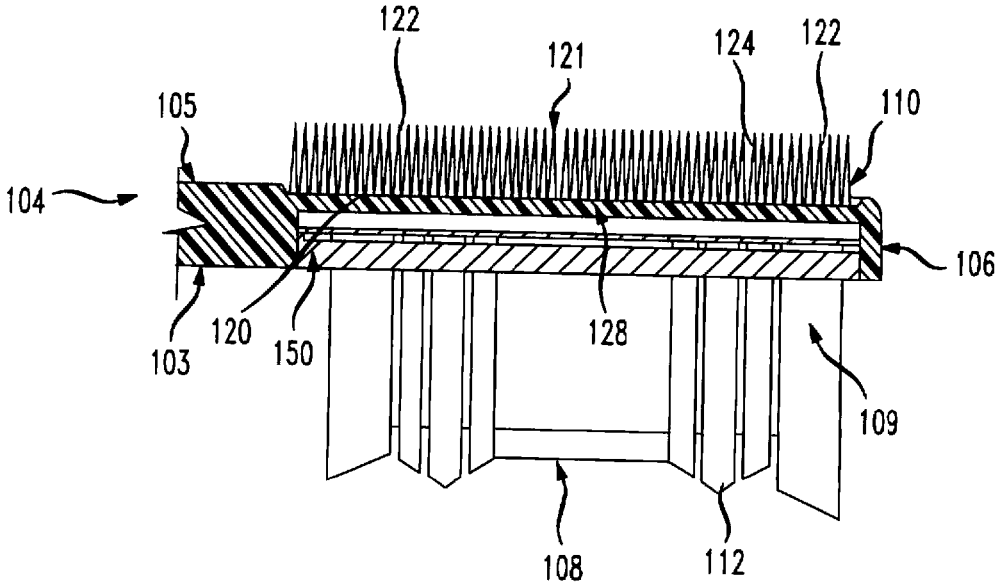
FIG. 11 is a cross-sectional view of the toothbrush head of FIG. 10.
Figure 12:
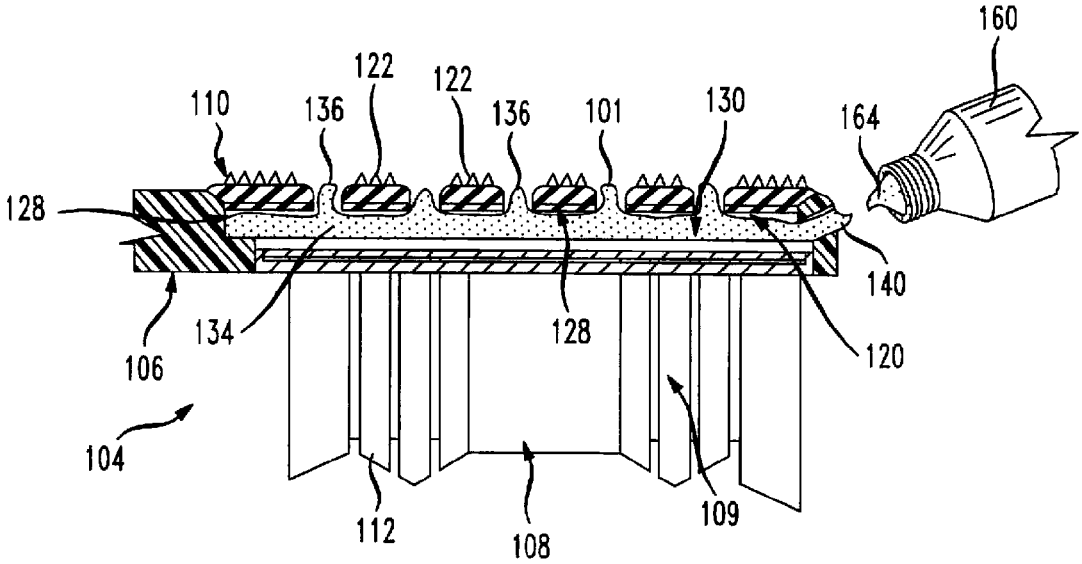
FIG. 12 is a cross-sectional view of another embodiment of a head of a toothbrush, the head having a dispenser dispensing an active into a reservoir within the head.

FIGS. 10-11 illustrate a toothbrush 100 having a second cleaning element 110 that includes a base 120 attached to the second face 105 of the head 104, the base 120 having a plurality of protrusions 122 thereon. The protrusions 122 are grouped tightly to form a plurality of ridges 124, and the ridges 124 define a plurality of channels 126 therebetween. The ridges 124 are formed in a series of patterns having a circular center ridge 124A surrounded by two elongated semicircular ridges 124B. The elongated channels 126 are configured to direct a fluid in contact with the head 104 around the center ridges 124A and toward the distal edge 107B and the proximal edge 107C of the head 104 and to disperse the fluid around the second cleaning element 110 when the implement 100 is moved in the oral cavity. Additionally, the protrusions 122 form bristle-like structures, which enhance cleaning of soft tissues in the oral cavity.

Reservoir Constructions

In the exemplary toothbrush constructions illustrated in FIGS. 12-29, the toothbrush 100 has a second cleaning element 110 that includes a base 120 attached to the second face 105 of the head 104 and one or more reservoirs 130 configured to receive an active/dentifrice 101 therein. In some constructions, such as the exemplary constructions illustrated in FIGS. 21-25 and 28-29, the reservoir 130 includes a depression 132 on an outer surface of the base 120 or on an outer surface of the head 104, adapted to receive the active/dentifrice 101 therein. In other toothbrush constructions as illustrated in FIGS. 12-20, the reservoir 130 includes a cavity 134 defined within the head 104. The cavity 134 can be defined between the base 120 and the head 104 or between the first cleaning element 108 and the second cleaning element 110. As shown in FIG. 12, a dispenser 160 containing an active 101 can be used to inject or insert the active 101 into the reservoir or reservoirs 130.

Cavity Constructions

FIG. 12 generally illustrates an example of a toothbrush 100 having a head 104 having a second cleaning element 110 that includes a base 120 attached to the second face 105 of the head 104. The base 120 defines a reservoir 130 configured to receive and hold an active 101 therein. The reservoir 130 is formed by a cavity 134 defined between the base 120 and the head 104. As shown in FIG. 12, a dispenser 160 containing an active 101 can be used to inject or insert the active 101 into the cavity 134. The second cleaning element 110 also has several apertures 136 in the base 120, extending from the cavity 134 to an exterior of the base 120, allowing the active 101 to move out of the cavity 134 and onto the outer surface of the second cleaning element 110. Additionally, the second cleaning element has a plurality of protrusions 122 on the surface of the base 120 to improve cleaning of oral surfaces. It is understood that the protrusions 122 may be dimensioned and configured to form channels 126 that extend from the center portion of the head 104 to the edges 107 of the head 104, such as shown in other constructions herein.

Figure 13:
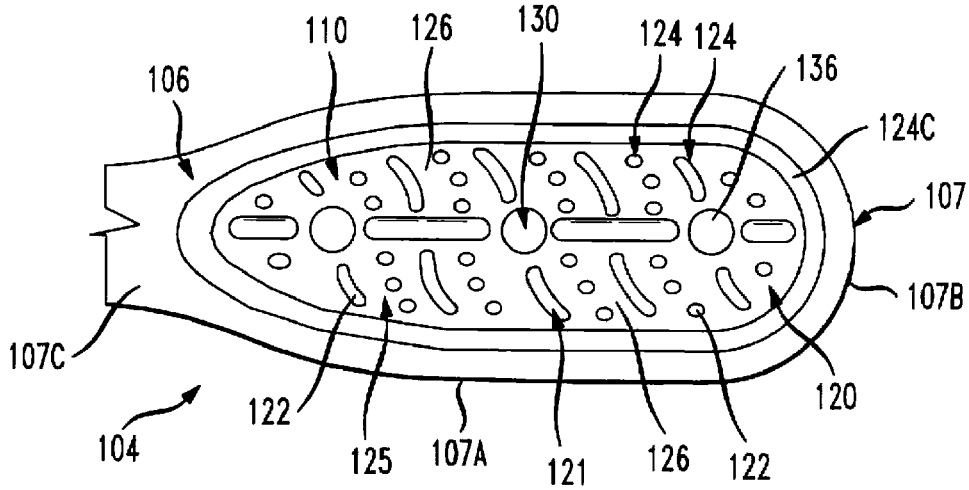
FIG. 13 is a plan view of another embodiment of a head of a toothbrush.
Figure 14:
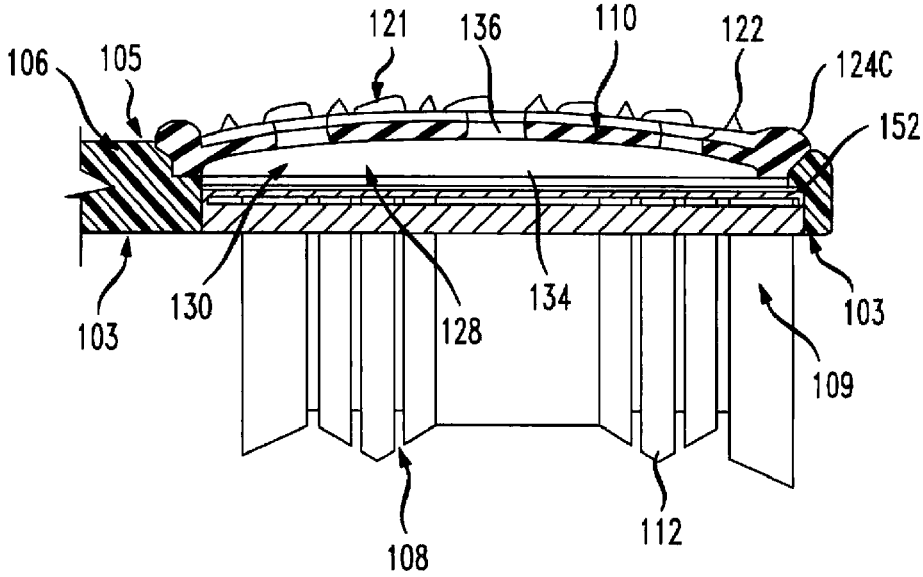
FIG. 14 is a cross-sectional view of the toothbrush head of FIG. 13.

FIGS. 13 and 14 illustrate an example of a toothbrush 100 having a head 104 having a second cleaning element 110 that includes a base 120 attached to the second face 105 of the head 104, the base 120 defining a reservoir 130 configured to receive and hold an active 101 therein. The reservoir 130 is formed by a cavity 134 defined between the base 120 and the head 104. The head 104 has a bristle cover 152 positioned above the bristle insert 109 to define a portion of the cavity 134. The second cleaning element 110 also has three apertures 136 in the base 120, extending from the cavity 134 to an exterior of the base 120, allowing the active 101 to move out of the cavity 134 and onto the outer surface of the second cleaning element 110. The design of the apertures 136 assist in metering the active 101 from the reservoir 130 during brushing. The apertures 136 can also be used for insertion of the active 101 into the reservoir 130. The base 120 of the second cleaning element 110 is soft and flexible, which causes the base 120 to flex during brushing, pumping the active 101, along with water and other fluids, into and out of the cavity 134, such as through the apertures 136. Additionally, the second cleaning element has a plurality of protrusions 122 on the surface of the base 120 to improve cleaning of oral surfaces. These protrusions 122 include nubs and ribs, which both contribute to improved cleaning of oral tissue, as well as form a perimeter ridge 124C around the outer edges of the second cleaning element 110 to retain the active 101 and other fluids on the second cleaning element 110 during brushing.

Channels 126 formed between the protrusions 122 also assist in dispersing such fluids around the second cleaning element. It is understood that, in the construction shown in FIGS. 13 and 14, the active 101 could be applied at locations other than the interior of the cavity 134, such as the outer surface of the second cleaning element 110, and the pumping action of the second cleaning element 110 will still function to improve distribution and dissolution of the active 101. It is also understood that the perimeter ridge 124C could be eliminated or modified to allow the edges of the second cleaning element 110 to be open, and the channels 126 could also be open at the edges of the second cleaning element 110.

Figure 15:
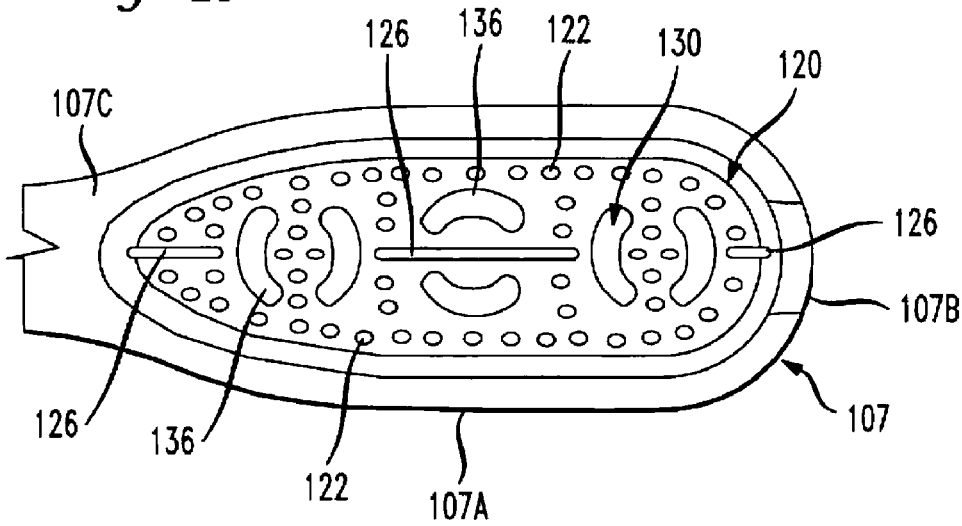
FIG. 15 is a plan view of another embodiment of a head of a toothbrush.
Figure 16:
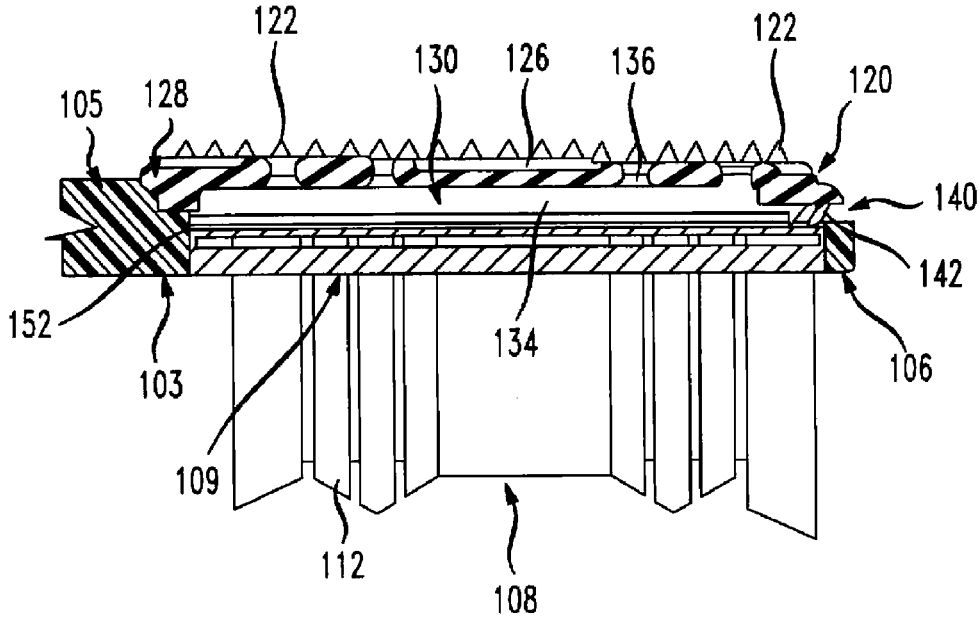
FIG. 16 is a cross-sectional view of the toothbrush head of FIG. 15.

FIGS. 15 and 16 illustrate an example of a toothbrush 100 having a head 104 having a second cleaning element 110 that includes a base 120 attached to the second face 105 of the head 104, the base 120 defining a reservoir 130 configured to receive and hold an active 101 therein. The reservoir 130 is formed by a cavity 134 defined between the base 120 and the head 104. The head 104 has a bristle cover 152 positioned above the bristle insert 109 to define a portion of the cavity 134. The second cleaning element 110 also has three apertures 136 in the base 120, extending from the cavity 134 to an exterior of the base 120, allowing the active 101 to move out of the cavity 134 and onto the outer surface of the second cleaning element 110. The apertures 136 are substantially kidney-shaped and are in confronting arrangement, and the design and arrangement of the apertures 136 results in even dispersion of the active 101 over the second cleaning element 110. The apertures 136 can also be used for insertion of the active 101 into the reservoir 130. The base 120 of the second cleaning element 110 is soft and flexible, which causes the base 120 to flex during brushing, pumping the active 101, along with water and other fluids, into and out of the cavity 134, such as through the apertures 136.

Additionally, the second cleaning element has a plurality of protrusions 122 on the surface of the base 120 to improve cleaning of oral surfaces. These protrusions 122 are in the form of nubs, which both contribute to improved cleaning of oral surfaces. Three channels 126 are defined in the base 120, which distribute the active 101 more evenly over the second cleaning element. Further, the second cleaning element 110 has a port 140 located at the distal edge 107B of the head 104. The port 140 includes a one-way flap or valve 142 which allows fluid flow into the cavity 134, but resists fluid flow out of the cavity 134. This port 140 can be used for insertion of active 101 into the reservoir 130, and also assists in cleaning the active 101 and other fluids from the reservoir 130. It is understood that, in the construction shown in FIGS. 15 and 16, the active 101 could be applied locations other than the interior of the cavity 134, such as the outer surface of the second cleaning element 110, and the pumping action of the second cleaning element 110 will still function to improve distribution and dissolution of the active 101.

Figure 17:
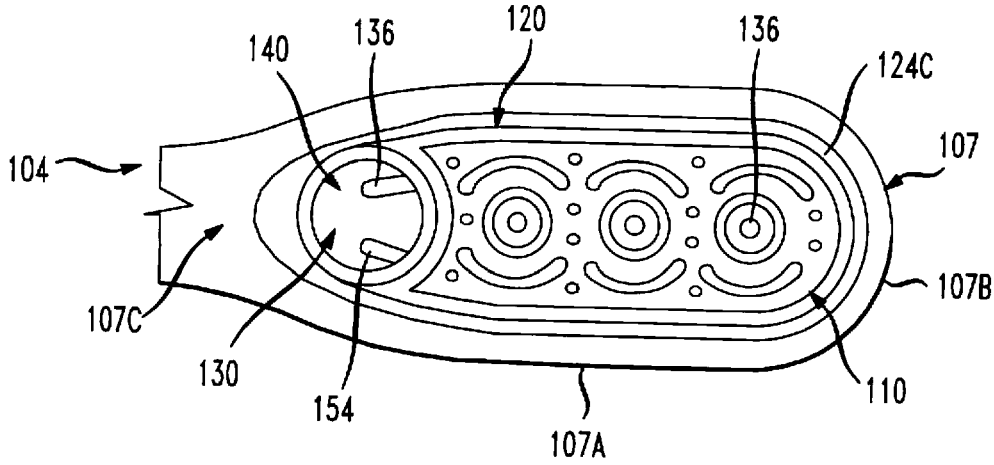
FIG. 17 is a plan view of another embodiment of a head of a toothbrush.
Figure 18:
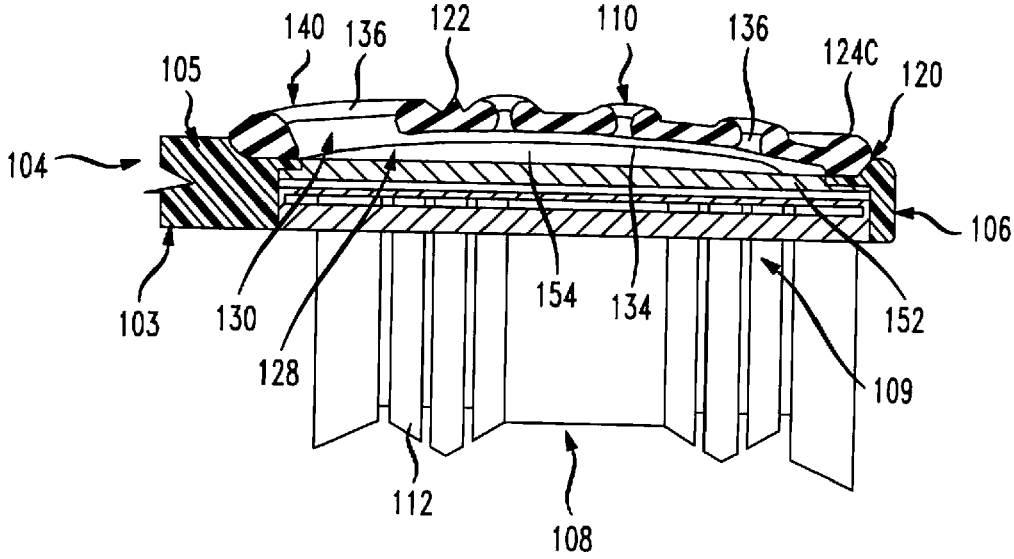
FIG. 18 is a cross-sectional view of the toothbrush head of FIG. 17.

FIGS. 17 and 18 illustrate an example of a toothbrush 100 having a head 104 having a second cleaning element 110 that includes a base 120 attached to the second face 105 of the head 104, the base 120 defining a reservoir 130 configured to receive and hold an active 101 therein. The reservoir 130 is formed by a cavity 134 defined between the base 120 and the head 104. The head 104 has a bristle cover 152 positioned above the bristle insert 109 to define a portion of the cavity 134, and the bristle cover 152 has guides 154 to distribute fluid more evenly within the cavity 134. The second cleaning element 110 also has four apertures 136 in the base 120, extending from the cavity 134 to an exterior of the base 120, allowing the active 101 to move out of the cavity 134 and onto the outer surface of the second cleaning element 110. One of the apertures 136 is enlarged and is adapted for use as a port 140 for insertion of the active 101 into the reservoir 130. The base 120 of the second cleaning element 110 is soft and flexible, which causes the base 120 to flex during brushing, pumping the active 101, along with water and other fluids, into and out of the cavity 134, such as through the apertures 136. Additionally, the second cleaning element has a plurality of protrusions 122 on the surface of the base 120 to improve cleaning of oral surfaces. These protrusions 122 include nubs and ribs, which both contribute to improved cleaning of oral surfaces, as well as form a perimeter ridge 124C around the outer edges of the second cleaning element 110 to retain the active 101 and other fluids on the second cleaning element 110 during brushing. It is understood that, in the construction shown in FIGS. 17 and 18, the active 101 could be applied locations other than the interior of the cavity 134, such as the outer surface of the second cleaning element 110, and the pumping action of the second cleaning element 110 will still function to improve distribution and dissolution of the active 101.

Figure 19:
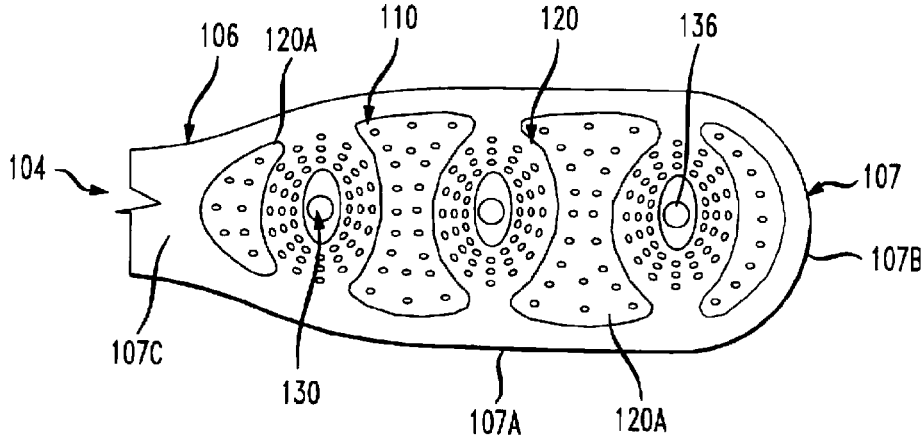
FIG. 19 is a plan view of another embodiment of a head of a toothbrush.
Figure 20:
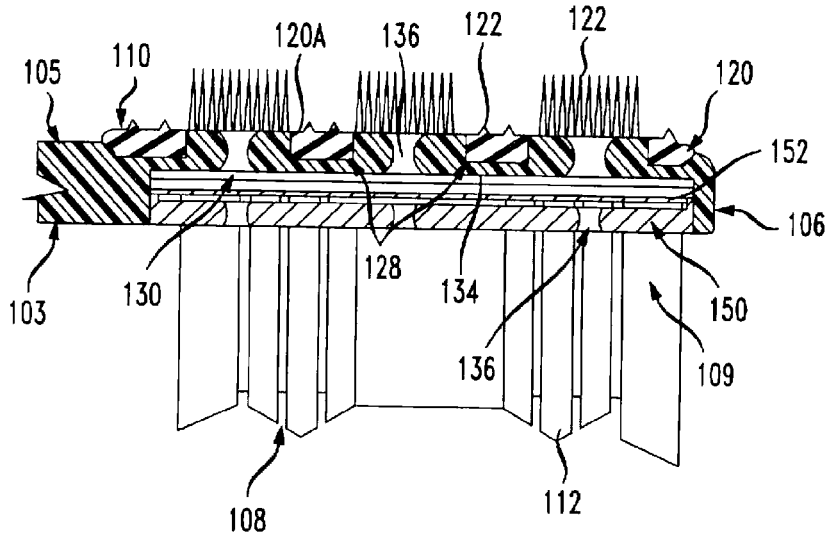
FIG. 20 is a cross-sectional view of the toothbrush head of FIG. 19.

FIGS. 19 and 20 illustrate an example of a toothbrush 100 having a head 104 having a second cleaning element 110 that includes a base 120 attached to the second face 105 of the head 104 and a reservoir 130 defined within the head 104 and configured to receive and hold an active 101 therein. The reservoir 130 is formed by a cavity 134 defined within the head 104. The head 104 has a bristle cover 152 positioned above the bristle insert 109 to define a portion of the cavity 134. The head 104 also has three apertures 136 therethrough, extending from the cavity 134 to an exterior of the head 104 proximate the second cleaning element 110, allowing the active 101 to move out of the cavity 134 and onto the outer surface of the second cleaning element 110. The apertures 136 also extend from the cavity 134, through the bristle cover 152, to an exterior of the head 104 proximate the first cleaning element 108. In this construction, the bristles 112 of the first cleaning element 108 may be arranged differently than in prior designs, such as including tufts of bristles that have in the center containing no bristles 112, to allow room for the apertures 136. It is understood that if a brush insert 109 is used, the apertures 136 may extend through the brush insert 109, as shown in FIG. 20. Thus, the apertures allow the active 101 and other fluids to communicate between the first cleaning element 108, the second cleaning element 110, and the reservoir 130.

Additionally, the second cleaning element 110 shown in FIGS. 19-20 has a plurality of protrusions 122 to improve cleaning of oral surfaces. The second cleaning element 110 has a base 120 formed of four inserts 120A that are mounted within recesses 128 on the support member 106 of the head 104, and the protrusions 122 of the second cleaning element 110 are located both on the surface of the base inserts 120A and on the second face 105 of the head 104. These protrusions 122 include nubs and bristle-like structures, which both contribute to improved cleaning of oral surfaces. The nubs 122 are formed on the inserts 120A. The bristle-like structures 122 are formed directly on the head, and extend in a radial pattern around each aperture 136. In the construction shown in FIGS. 19 and 20, the active 101 can be applied to the second cleaning element 110, and the apertures 136 function to improve distribution and dissolution of the active 101, particularly between the first and second cleaning elements 108, 110. The active 101 can also be applied into the cavity 134 via the apertures 136.

Surface Reservoir Constructions

Figure 21:
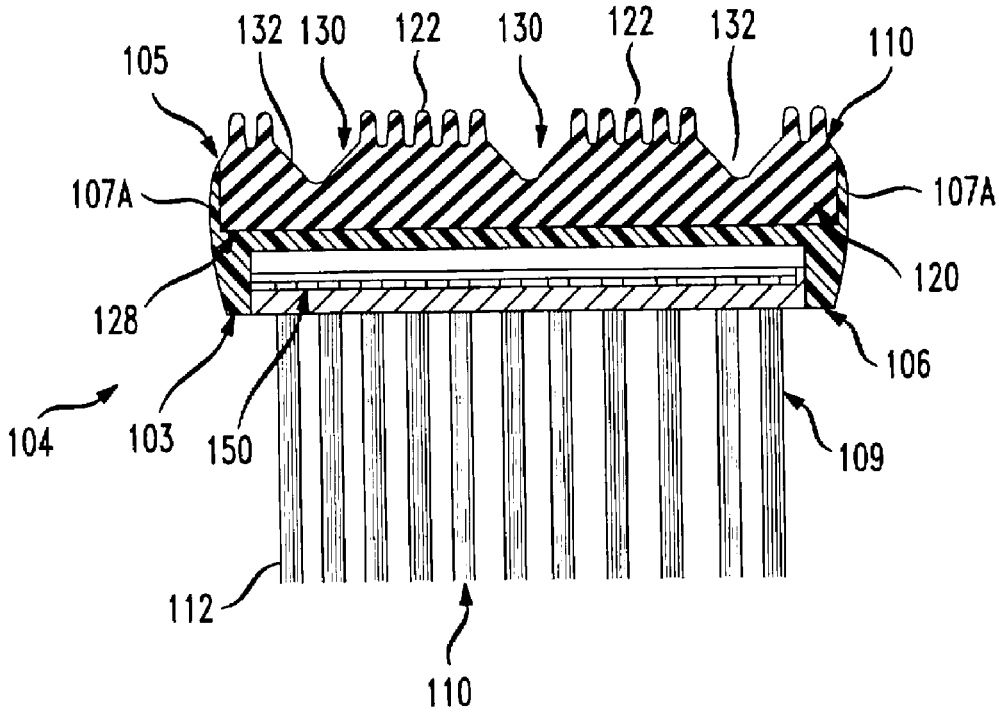
FIG. 21 is a cross-sectional view of another embodiment of a head of a toothbrush, taken perpendicular to a direction of extension of a handle attached to the head.

FIG. 21 illustrates an example of a toothbrush 100 having a head 104 having a second cleaning element 110 that includes a base 120 attached to the second face 105 of the head 104, the base 120 defining three reservoirs 130 configured to receive and hold a dentifrice 101 therein. The reservoirs 130 are each formed by one of three depressions 132 on the outer surface of the base 120. A dentifrice 101 may be applied to the second cleaning element 110, as shown in FIG. 1, and the depressions 132 will receive and hold the dentifrice 101 therein. The second cleaning element 110 also has a plurality of protrusions 122 thereon, which are adapted to clean the soft tissues of the mouth and assist in the dissolution and dispersion of the dentifrice 101. Additionally, as discussed below, the reservoirs 130 may be designed in a complementary manner with the cap 162 or opening 164 of the active dispenser 160 so that the active 101 is dispensed in a form or shape that is complementary to the design of the reservoirs 130.

Figure 22:
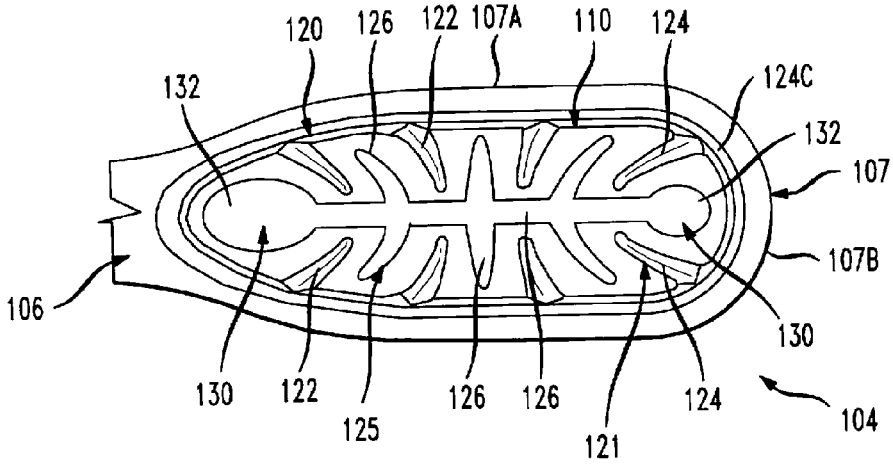
FIG. 22 is a plan view of another embodiment of a head of a toothbrush.
Figure 23:
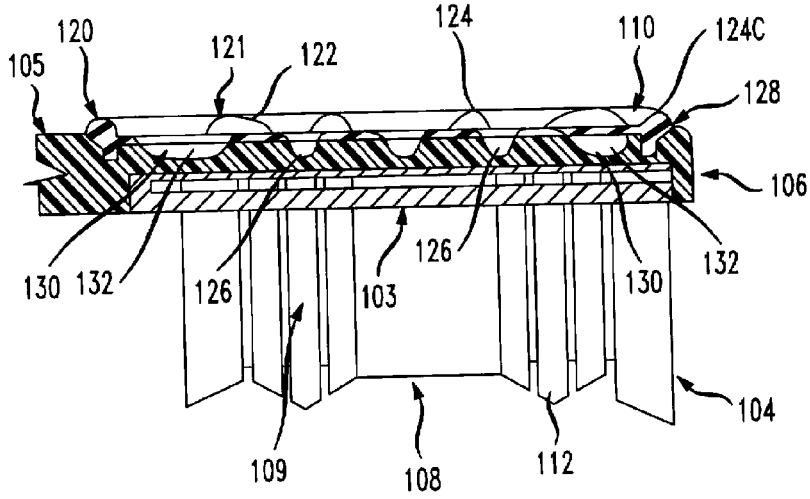
FIG. 23 is a cross-sectional view of the toothbrush head of FIG. 22.

FIGS. 22 and 23 illustrate an example of a toothbrush 100 having a head 104 having a second cleaning element 110 that includes a base 120 attached to the second face 105 of the head 104, the base 120 defining two reservoirs 130 configured to receive and hold a dentifrice or other active 101 therein. Each of the reservoirs 130 is formed by a depression 132 on the outer surface of the base 120. An active 101 may be applied to the second cleaning element 110, as shown in FIG. 1, and the depressions 132 will receive and hold the active 101 therein. The second cleaning element 110 also has a plurality of rib-like protrusions 122 thereon. Each of the protrusions 122 itself forms a ridge 124, and the ridges 124 define a plurality of channels 126 therebetween. Both the ridges 124 and the channels 126 extend outwardly in an elongated, curvilinear manner from a point proximate a centerline of the base 120 to the lateral edges 107A of the head 104. Another channel 126 extends between the two reservoirs 130. The channels 126 are configured to distribute the active 101 held in the reservoirs 130, as well as other fluids such as water and saliva, around the second cleaning element 110 when the implement 100 is moved in the oral cavity. The protrusions 122 also form a perimeter ridge 124C around the outer edges of the second cleaning element 110 to retain the active 101 and other fluids on the second cleaning element 110 during brushing.

Figure 24:
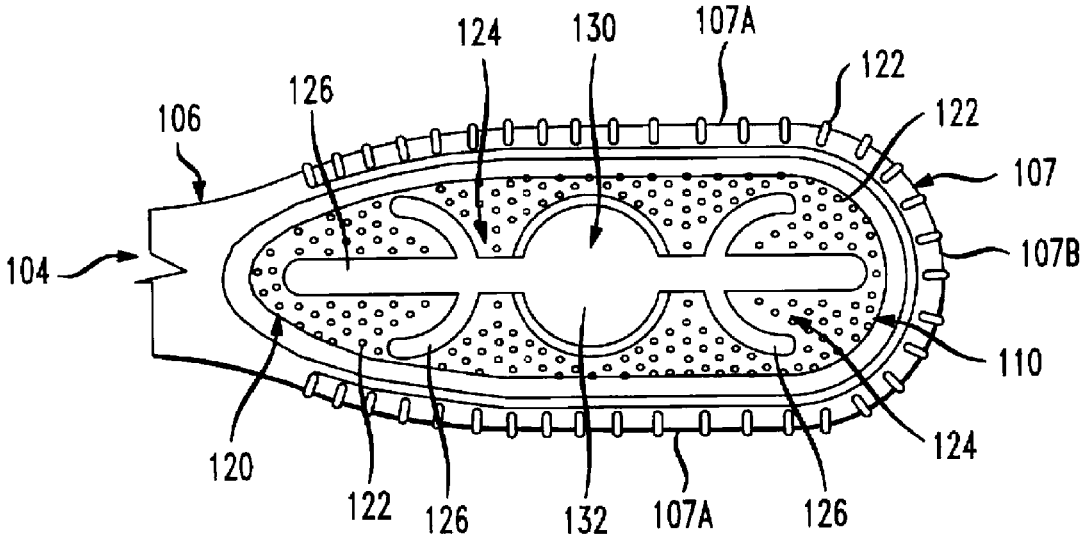
FIG. 24 is a plan view of another embodiment of a head of a toothbrush.
Figure 25:
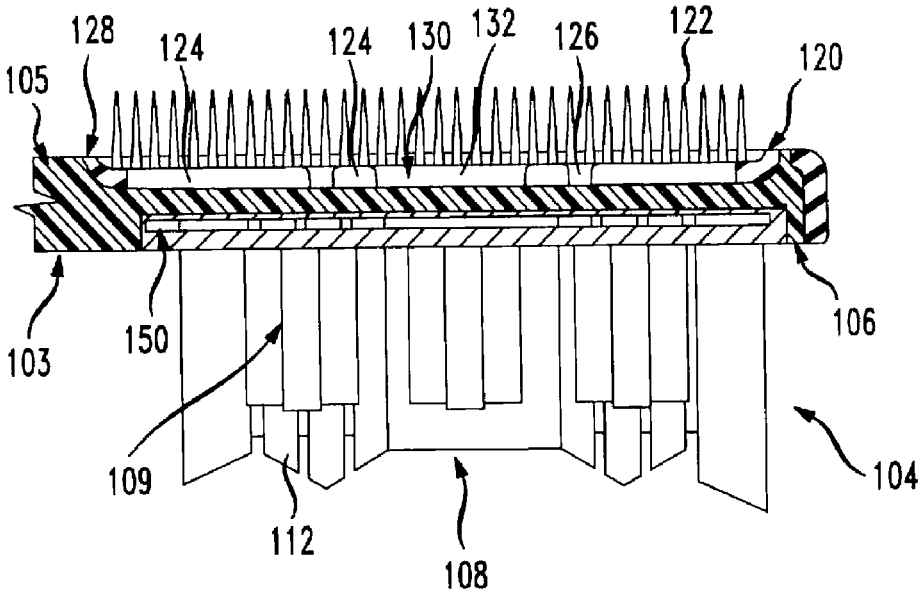
FIG. 25 is a cross-sectional view of the toothbrush head of FIG. 24.

FIGS. 24 and 25 illustrate an example of a toothbrush 100 having a head 104 having a second cleaning element 110 that includes a base 120 attached to the second face 105 of the head 104, the base 120 defining a reservoir 130 configured to receive and hold a dentifrice or other active 101 therein. The reservoir 130 is formed by a depression 132 on the outer surface of the base 120. An active 101 may be applied to the second cleaning element 110, as shown in FIG. 1, and the depression 132 will receive and hold the active 101 therein. The second cleaning element 110 also has a plurality of protrusions 122 thereon. The protrusions 122 form elongated ridges 124, and the ridges 124 define a plurality of channels 126 therebetween. The protrusions 122 further have bristle-like protrusions 122 extending there from, which both assist in cleaning oral surfaces and increase the profile of the ridges 124 relative to the channels 126. In one construction, the bristles 122 have a height of 3.5 mm and are spaced approximately 0.381 mm. Both the ridges 124 and the channels 126 are elongated and extend from a point proximate a centerline of the base 120 to the lateral edges 107A of the head 104. Another channel 126 extends outward from the reservoir 130, along the centerline. The channels 126 are configured to distribute the active 101 held in the reservoirs 130, as well as other fluids such as water and saliva, around the second cleaning element 110 when the implement 100 is moved in the oral cavity. Additionally, base 120 of the second cleaning element 110 is recessed relative to the peripheral edges 107 of the head 104, as illustrated in FIG. 23, which helps keep the active 101 on the base 120 during brushing. The second cleaning element 110 also includes a series of ribs 122 around the peripheral edges 107 of the head 104, which further assist in cleaning surfaces of the oral cavity.

Figure 28:
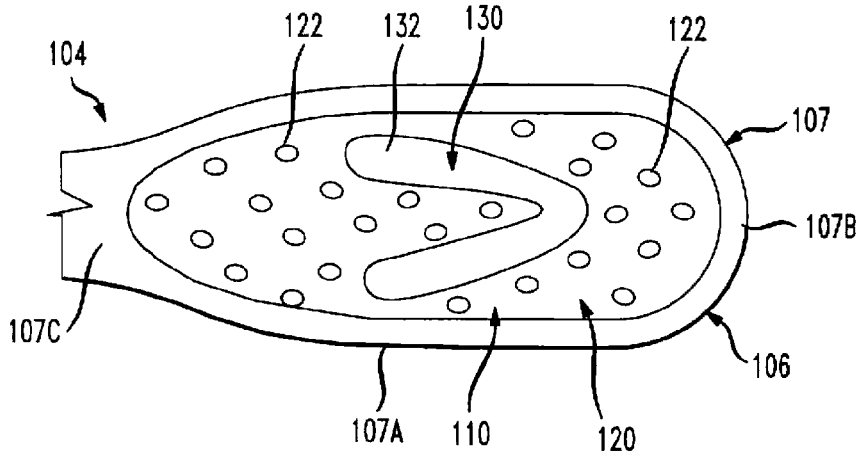
FIG. 28 is a plan view of another embodiment of a head of a toothbrush.
Figure 29:
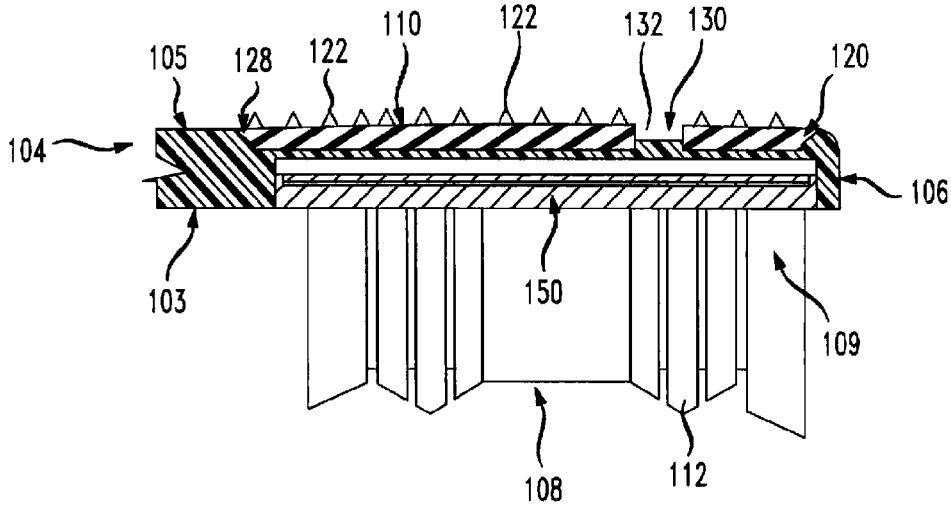
FIG. 29 is a cross-sectional view of the toothbrush head of FIG. 28.

FIGS. 28 and 29 illustrate an example of a toothbrush 100 having a head 104 having a second cleaning element 110 that includes a base 120 attached to the second face 105 of the head 104. The base 120 defines a reservoir 130 configured to receive and hold a dentifrice or other active 101 therein. The reservoir 130 is formed by a boomerang-shaped depression 132 on the outer surface of the base 120. An active 101 may be applied to the second cleaning element 110, as shown in FIG. 1, and the depression 132 will receive and hold the active 101 therein. The second cleaning element 110 also has a plurality of protrusions 122 thereon. The protrusions 122 are in the form of nubs and improve the cleaning of oral surfaces.

Figure 26:
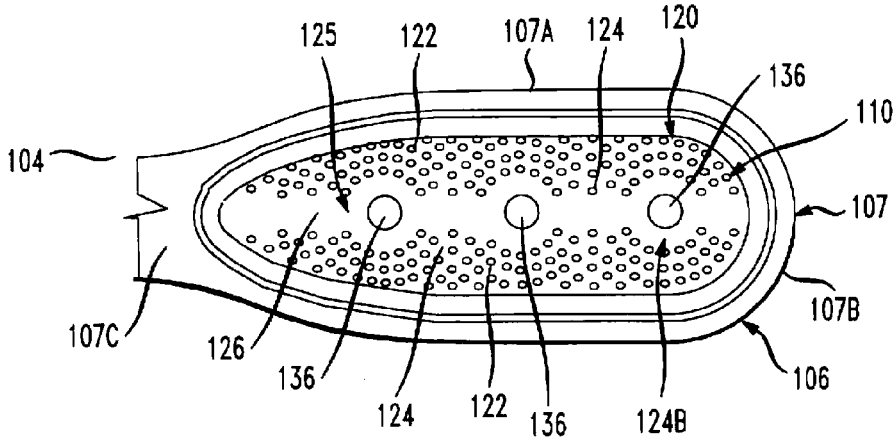
FIG. 26 is a plan view of another embodiment of a head of a toothbrush.
Figure 27:
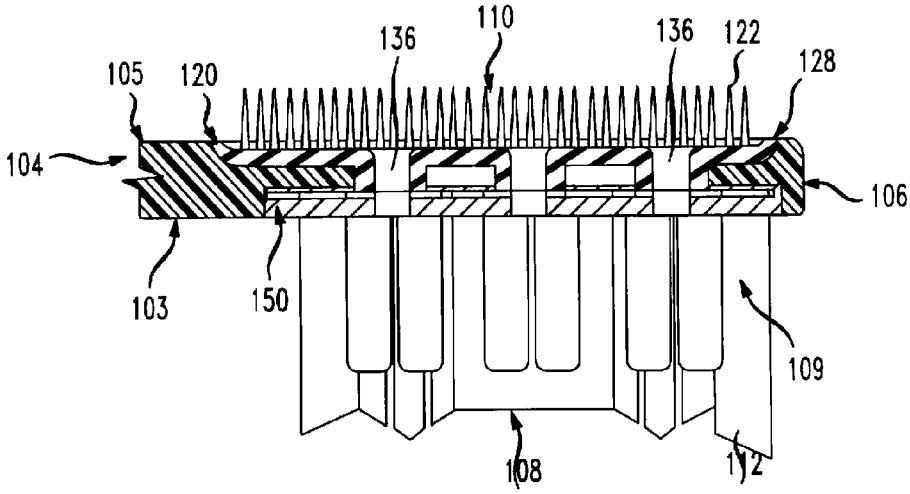
FIG. 27 is a cross-sectional view of the toothbrush head of FIG. 26.

In the exemplary construction illustrated in FIGS. 26-27, the toothbrush 100 has a second cleaning element 110 that includes a base 120 attached to the second face 105 of the head 104, the base 120 having a plurality of protrusions 122 thereon. The protrusions 122 are grouped tightly to form a plurality of ridges 124, and the ridges 124 define a channel 126 therebetween. The ridges 124 are formed in a series of dispensing arrangements, having two semicircular ridges 124B disposed about a center point, similar to the arrangement in the toothbrush 100 shown in FIGS. 10-11. At each of the three center points, the second cleaning element 110 has an aperture 136. Similar to the construction shown in FIGS. 19-20, the apertures 136 extend into and through the head 104 to the first cleaning element 108, allowing the active 101 and/or other fluids to communicate between the first and second cleaning elements 108, 110. The elongated channel 126 is configured to direct and disperse a fluid in contact with the head 104 around the second cleaning element, including directing the fluid toward the apertures and toward the distal edge 107B and the proximal edge 107C of the head 104. Additionally, the protrusions 122 form bristle-like structures, which enhance cleaning of soft tissues in the oral cavity. Further, the brush 100 shown in FIGS. 26 and 27 has a polypropylene head 104, which is textured around the peripheral edges 107.

Figure 30:
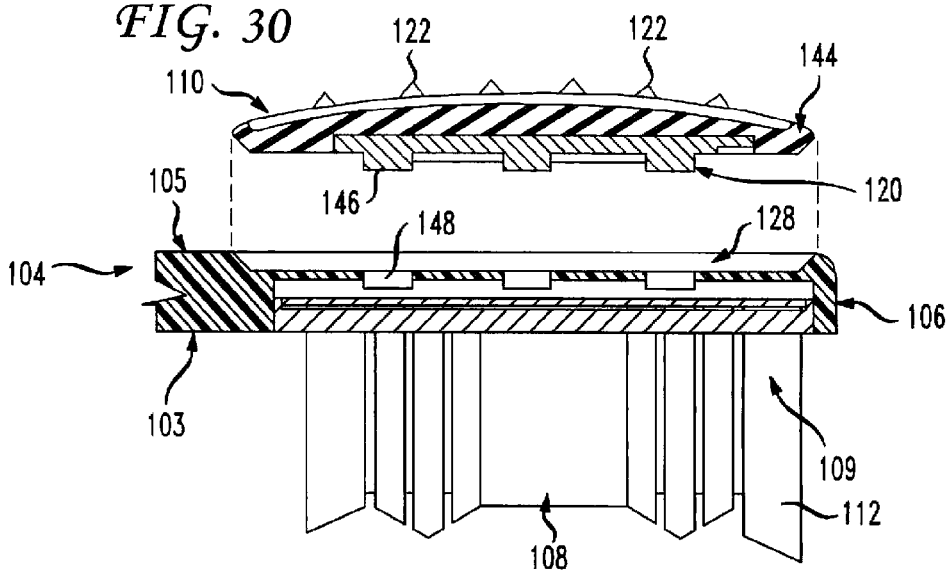
FIG. 30 is a cross-sectional exploded view of another embodiment of a head of a toothbrush and a cleaning element.
Figure 31:
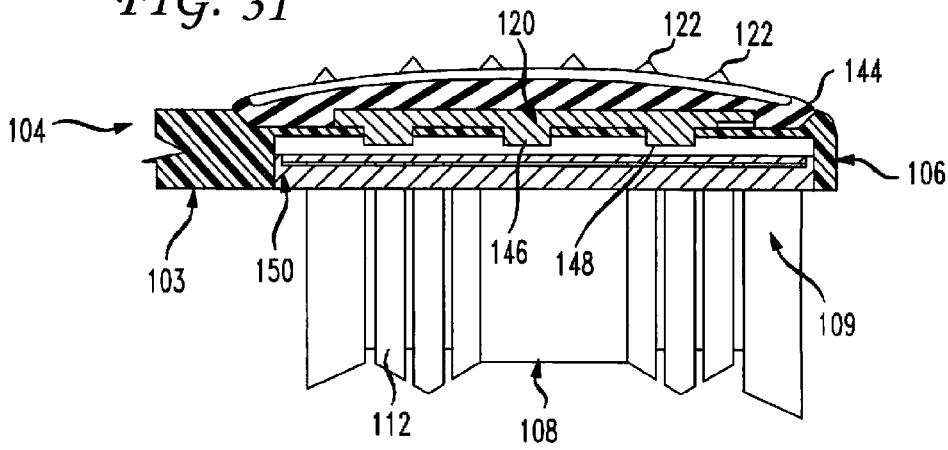
FIG. 31 is a cross-sectional view of the toothbrush head of FIG. 30, shown with the cleaning element affixed to the head.
Figure 32:
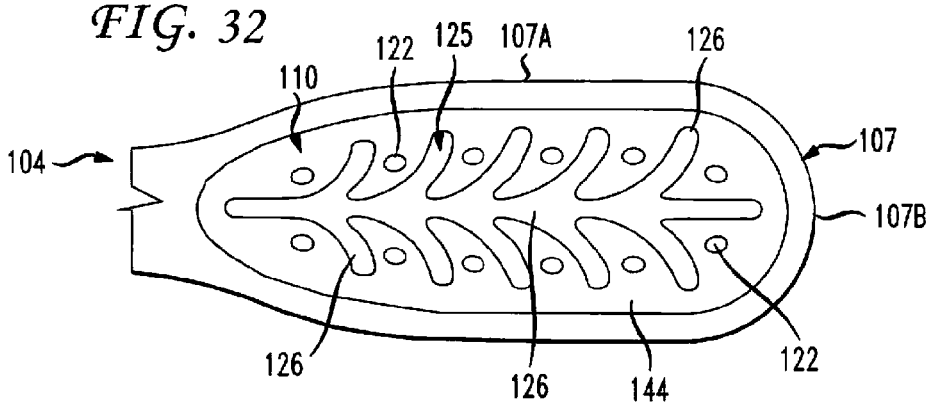
FIG. 32 is a plan view the toothbrush head and cleaning element of FIG. 30.

In the exemplary construction illustrated in FIGS. 30-32, the toothbrush 100 has a removable, replaceable second cleaning element 110 that includes a base 120 attached to the second face 105 of the head 104, the base 120 having a consumable portion 144 attached thereto. The consumable portion 144 can be made of any material that is consumed, such as by wear, dissolution, melting, or other mechanism, during use of the toothbrush 100. For example, in one construction, the consumable portion 144 is a breath mint or other similar article, which dissolves slowly during use. After a number of uses, the consumable portion will be used up and require removal and replacement. In the toothbrush 100 shown, the base 120 is constructed of a non-consumable material, and is removably connected to the head 104 via a snap arrangement. Thus, the used cleaning element 110 can be removed and replaced with a new cleaning element 110. In the snap arrangement, the base 120 contains male snap members 146 and the head 104 contains female snap members 148, which cooperate to form a snap connection. In other constructions, another type of removable connection may be used, or the base 120 may be permanently connected to the head 104, with the consumable portion 144 being removable from the base 120. Additionally, in the construction shown in FIGS. 30-32, the consumable portion 144 has a plurality of protrusions 122 thereon, forming ridges 124 which define a plurality of channels 126 on the surface of the consumable portion 144. The protrusions 122 assist in cleaning oral surfaces, and the channels 126 direct and disperse fluid around the surface of the consumable portion 144.

In one construction, the second cleaning element 110 could be infused with an active, such as by combining an oil or other active with the protrusions 122 or other toothbrush head component, for direct delivery during brushing.

Figure 33:
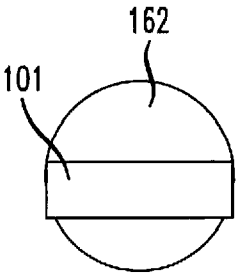
FIGS. 33-37 are schematic views of dispenser openings and subsequent dentifrice ribbon profiles according to the present invention.
Figure 34:
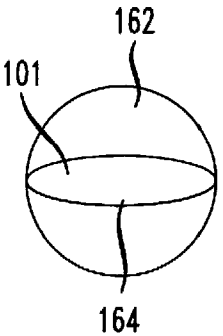
Figure 35:
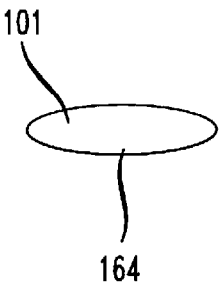
Figure 36:
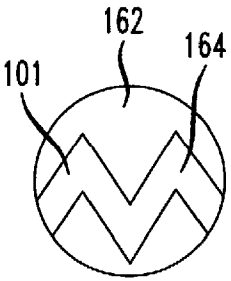
Figure 37:
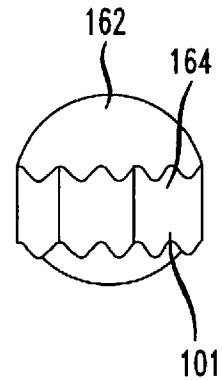

Additionally, a cap 162 of the dispenser 160 containing the active 101 can be redesigned to have an opening 164 with a shape which dispenses the active 101 in a shape that improves dissolution of the active 101. Manipulating the shape of a ribbon of active 101 can increase the surface area of the active 101 and improve dissolution and dispersion of the active. The cap 162 of the dispenser 160 containing the active 101 can be also be redesigned to have an opening 164 with a shape which is complementary to the design of the brush head 104. The cap 162 and/or opening 164 may be designed in a complementary manner with the reservoir 130 of the second cleaning element 101 so that the active 101 is dispensed in a form or shape that is complementary to the design of the reservoirs 130. For example, the active 101 may form a ribbon that is shaped the same as the contour of the reservoir 130. Additionally, the cap 162 and/or opening 164 can be designed to mate with a port 140 on the brush head 104 for dispensing the active 101. Examples of advantageous shapes for the cap 162 and opening 164 (and the resultant ribbon of active 101) are illustrated in FIGS. 33-37. FIG. 33 shows a construction having a rectangular shaped cap opening 164. FIG. 34 shows a construction having an oval shaped cap opening 164. FIG. 35 shows a construction having a larger oval shaped cap opening 164. FIG. 36 shows a construction having an M-shaped cap opening 164. FIG. 37 shows a construction having a wave shaped cap opening 164. With these shapes, the head 104 and/or cleaning elements 108,110 may include a structure defining a profile that mates with the particular shape of the opening 164. For example, the brush head 104 may have a surface profile in the form of the depressions 132, as in FIG. 21, and the opening 164 may be designed to mate with the shape of these depressions 132. Other shapes which provide similar benefits are also possible.

In operation, the previously described features, individually and/or in any combination, improves cleaning performance of toothbrushes. These advantages are also achieved by the cleaning elements and the synergistic effects. While the various features of the toothbrush 100 work together to achieve the advantages previously described, it is recognized that individual features and sub-combinations of these features can be used to obtain some of the aforementioned advantages without the necessity to adopt all of these features. For example, a toothbrush 100 could be designed with the second cleaning element 110 having the channels 126 configured to direct fluid toward the edges 107 of the head and also have the reservoir 130 that contains a dentifrice therein. Such unique combinations of elements improve and enhance cleaning and teeth whitening performance of the toothbrushes of the present invention.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The terms "first," "second," "proximal," "distal," etc., as used herein, are intended for illustrative purposes only and do not limit the embodiments in any way. Accordingly, while the specific embodiments have been illustrated and described, numerous modifications come to mind without significantly departing from the spirit of the invention. Thus, the spirit and scope of the invention should be construed broadly as set forth in the appended claims.

What is claimed is:

1. An oral care implement, comprising:

a handle;

a head having a longitudinal axis connected to the handle;

a cleaning element connected to the head, the cleaning element having structure defining a plurality of channels, wherein the structure comprises a plurality of spaced apart ridges and the channels are formed between adjacent ridges;

wherein each of the ridges comprises a first arcuate segment having a concave side facing towards the handle and a second arcuate segment having a concave side facing away from the handle, the first and second arcuate segments spaced apart and disposed on opposing sides of the longitudinal axis; and wherein the channels are configured to direct fluid in contact with the head toward an edge of the head when the implement is moved.

2. The oral care implement of claim 1, further comprising a tooth cleaning element connected to the head, the tooth cleaning element comprising a plurality of bristles extending from the head, the bristles adapted to clean teeth.

3. The oral care implement of claim 2, wherein the head has first and second opposed faces, the bristles of the tooth cleaning element extending from the first face, and wherein the cleaning element comprises a base mounted on the second face of the head.

4. The oral care implement of claim 1, wherein for each ridge, the first and second arcuate segments collectively form a serpentine shape.

5. The oral care implement of claim 1, further comprising a perimeter ridge surrounding a peripheral edge of the cleaning element.

6. The oral care implement of claim 1, wherein each of the first and second arcuate segments are formed by a protrusion.

7. The oral care implement of claim 1, wherein each of the first and second arcuate segments are formed by a plurality of protrusions.

8. The oral care implement of claim 1, wherein each of the ridges is substantially serpentine in shape and extends from one lateral edge of the head to another opposed lateral edge of the head.

9. The oral care implement of claim 1, wherein each of the first and second arcuate segments extend from one of two opposed lateral edges of the head to a point proximate a centerline of the head.

10. The oral care implement of claim 1, wherein at least one of the channels is configured to direct the fluid toward a distal edge of the head.

11. The oral care implement of claim 1, wherein at least one of the channels is configured to direct the fluid toward at least one of two opposed lateral edges of the head.

12. The oral care implement of claim 1 wherein at least one channel extends to a lateral edge of the head and at least one channel extends proximate a distal edge of the head.

13. The oral care implement of claim 1 wherein at least one of the channels is open at an edge of the head.

14. An oral care implement, comprising:

a handle;

a head coupled to the handle, the head having a longitudinal axis and first and second opposed faces;

a first cleaning element connected to the head, the first cleaning element comprising a plurality of bristles extending from the first face of the head, the bristles adapted to clean teeth;

a second cleaning element comprising a base connected to the second face of the head, the base having a plurality of elongated ridges defining a plurality of elongated channels therebetween on the base, such that the channels are recessed relative to the ridges;

wherein each of the elongated ridges comprises a first arcuate segment having a concave side facing towards the handle and a second arcuate segment having a concave side facing away from the handle, the first and second arcuate segments spaced apart and disposed on opposing sides of the longitudinal axis to collectively form a serpentine shape; and wherein the channels are configured to direct a fluid in contact with the head toward an edge of the head when the implement is moved.

15. The oral care implement of claim 14, further comprising a plurality of protrusions positioned between adjacent elongated ridges.

16. The oral care implement of claim 14, wherein each of the ridges is oriented at an oblique angle relative to the longitudinal axis.

17. The oral care implement of claim 14, wherein each of the ridges is substantially serpentine in shape and extends from one lateral edge of the head to another opposed lateral edge of the head.

18. The oral care implement of claim 14, wherein the channels are configured to direct the fluid toward a distal edge of the head, the distal edge being farthest from the handle.

19. The oral care implement of claim 14, wherein the channels are configured to direct the fluid toward opposed lateral edges of the head.

20. An oral care implement, comprising:

a handle;

a head coupled to the handle, the head having opposed first and second faces;

a first cleaning element connected to the head, the first cleaning element comprising a plurality of bristles extending from the first face of the head, the bristles adapted to clean teeth;

a second cleaning element comprising a flexible base connected to the second face of the head, the base having an outer surface with a plurality of protrusions thereon;

a reservoir defined between the first cleaning element and the base of the second cleaning element, the reservoir configured to receive a dentifrice therein; and an aperture in the base forming a passageway between the reservoir and the outer surface of the base.

21. The oral care implement of claim 20, wherein the plurality of protrusions are arranged in a circular pattern around the aperture.

22. The oral care implement of claim 20, further comprising a plurality of apertures forming passageways between the reservoir and the outer surface of the base.

23. The oral care implement of claim 22, wherein the protrusions are arranged in circular patterns around each of the apertures.

24. The oral care implement of claim 20, wherein the plurality of protrusions define a plurality of elongated channels therebetween such that the channels are recessed relative to the protrusions, and wherein the channels are configured to distribute the dentifrice around the second cleaning element when the implement is moved.

25. The oral care implement of claim 20, wherein the reservoir is a cavity defined between the base of the second cleaning element and the head.

26. The oral care implement of claim 25, wherein the base is constructed of a soft plastic and is configured to pump the dentifrice into and out of the cavity through the aperture when the implement is moved.

27. The oral care implement of claim 20, wherein the plurality of protrusions define a plurality of elongated channels therebetween, the channels extending from a central portion of the head towards an edge of the head, wherein the channels are adapted to direct dentifrice toward the edge of the head when the implement is moved.

28. The oral care implement of claim 20, wherein the head comprises a port in communication with the reservoir and an exterior of the head, the port having a one-way valve adapted to permit fluid flow into the reservoir.

29. An oral care implement, comprising:

a handle;

a head having a longitudinal axis connected to the handle;

a cleaning element connected to the head, the cleaning element comprising a base having an outer surface;

a reservoir defined between the base of the cleaning element and the head and configured to receive a dentifrice therein;

an aperture in the base forming a passageway between the reservoir and the outer surface of the base, the aperture positioned along the longitudinal axis;

a first arcuate ridge segment disposed on a first side of the longitudinal axis and having a concave side facing towards the handle;

a second arcuate ridge segment disposed on a second side of the longitudinal axis opposite the first side and having a concave side facing away from the handle; and wherein the aperture is positioned between the first arcuate ridge segment and the second arcuate ridge segment.

* * * * *